US007450887B2

(12) United States Patent
Kim et al.

(10) Patent No.: US 7,450,887 B2
(45) Date of Patent: Nov. 11, 2008

(54) ROLLER DEVICE INCLUDING DRIVING GEAR INTEGRALLY INCLUDING GEAR UNIT AND BUSHING UNIT FOR AN IMAGE FORMING APPARATUS

(75) Inventors: Jin-hong Kim, Incheon (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 352 days.

(21) Appl. No.: 11/356,963

(22) Filed: Feb. 21, 2006

(65) Prior Publication Data

US 2006/0260482 A1 Nov. 23, 2006

(30) Foreign Application Priority Data

May 23, 2005 (KR) ..... 10-2005-0043042

(51) Int. Cl.
*G03G 15/00* (2006.01)
*G03G 15/02* (2006.01)
*G03G 15/08* (2006.01)

(52) U.S. Cl. ..... 399/167; 399/176; 399/279; 399/281; 399/256

(58) Field of Classification Search ..... 399/167, 399/176, 256, 279, 281; 271/10.13
See application file for complete search history.

(56) References Cited

U.S. PATENT DOCUMENTS 5,141,217 A * 8/1992 Lim et al. ..... 271/10.13
5,169,136 A * 12/1992 Yamagata et al. ..... 271/10.13

FOREIGN PATENT DOCUMENTS

| | | |
|---|---|---|
| JP | 01-128248 | 9/1989 |
| JP | 03-083748 | 4/1991 |
| JP | 09-226975 | 9/1997 |
| KR | 1998-19011 | 6/1998 |
| KR | 1998-72732 | 11/1998 |
| KR | 1999-29305 | 7/1999 |
| KR | 1999-29332 | 7/1999 |

OTHER PUBLICATIONS

Korean Office Action issued May 25, 2006 re: Korean Application No. 2005-43042 (3 pp).

* cited by examiner

*Primary Examiner*—William J Royer
(74) *Attorney, Agent, or Firm*—Stein, McEwen & Bui, LLP

(57) ABSTRACT

A roller device for an image forming apparatus includes a rotary roller having a shaft; and a driving gear connected with the shaft to rotate together with the roller and integrally including a gear unit for power transmission and a bushing unit for position control of the roller. The shaft is engaged with a shaft hole formed to the driving gear and having a predetermined depth. The bushing unit of the driving gear is supported by a bushing support unit of a frame.

23 Claims, 3 Drawing Sheets

ROLLER DEVICE INCLUDING DRIVING GEAR INTEGRALLY INCLUDING GEAR UNIT AND BUSHING UNIT FOR AN IMAGE FORMING APPARATUS

CROSS-REFERENCE TO RELATED APPLICATIONS

This application claims the benefit of Korean Application No. 2005-43042, filed May 23, 2005, in the Korean Intellectual Property Office, the disclosure of which is incorporated herein by reference.

BACKGROUND OF THE INVENTION

1. Field of the Invention

Aspects of the present invention relate to a roller for an image forming apparatus such as a printer, a copy machine, and a facsimile. More particularly, aspects of the present invention relates to a roller device for an image forming apparatus that is capable of precisely controlling the position of a roller.

2. Description of the Related Art

Image forming apparatuses generally comprise a photoconductive medium, a developing roller, a developer supplying roller, an agitator, a cleaning roller, a developer controlling blade, and a cleaning blade. Rotary rollers such as the photoconductive medium, the developing roller, the developer supplying roller and the agitator are rotated according to a predetermined velocity and direction by a driving force transmitted through a predetermined gear train. In an image forming apparatus, control of the position of rollers is a significant matter since the positioning of rollers in a frame can greatly affect the image forming operation.

As shown in FIG. 1, which shows a generic image forming apparatus, rollers 1, 2 and 3 are position-regulated by being supported by a side frame 4. Reference numeral 5 of FIG. 1 denotes a main frame of the image forming apparatus. FIG. 2 shows an example of a conventional roller device for the image forming apparatus.

As shown in FIG. 2, the roller device in the generic image forming apparatus comprises a rotary roller 10 having a shaft 10*a*, a driving gear 11 connected to the shaft 10*a* for power transmission, and bushings 12 and 12' that respectively fit onto opposite ends of the shaft 10*a*. The roller device is mounted to a predetermined location of the side frame 4 using the bushings 12 and 12'.

Since the roller 10 is connected to the side frame 4 through the bushings 12 and 12' as described above, the roller 10 could be mis-aligned due to assembly tolerance or geometric tolerance. When the roller 10 is wrongly aligned, especially when the bushings 12 and 12' are wrongly aligned, defects in the image forming process, such as void spots in the image at regular intervals (white void), unevenness in the horizontal density of the image, unevenness in the development and transfer of image-forming material to the image, and inferior application of the developer, may be caused. As a result, the image quality can be considerably degraded.

SUMMARY OF THE INVENTION

An aspect of the present invention is to solve at least the above and/or other problems and disadvantages and to provide at least the advantages described below. Accordingly, an aspect of the present invention is to provide a roller device for an image forming apparatus, capable of precisely controlling a position of a roller with respect to a frame which supports the roller without requiring any additional dedicated part.

Another aspect of the present invention is to provide a roller device for an image forming apparatus, in which assembly tolerance and geometric tolerance can be easily controlled by reducing the number of parts of the roller device.

Additional aspects and/or advantages of the invention will be set forth in part in the description which follows and, in part, will be obvious from the description, or may be learned by practice of the invention.

In order to achieve the above-described and/or other aspects of the present invention, there is provided a roller device for an image forming apparatus, comprising a rotary roller having a shaft; and a driving gear connected with the shaft to rotate together with the roller and integrally including a gear unit for power transmission and a bushing unit for position control of the roller.

The driving gear has a shaft hole having a predetermined depth, and the shaft and the shaft hole may be engaged with each other through a D-cut.

The roller may be an electrifying roller, a developer supplying roller, a developing roller or an agitator.

According to another aspect of the present invention, a roller device for an image forming apparatus comprises a rotary roller having a shaft; a driving gear having a shaft hole for insertion of the shaft, connected with the roller to rotate together with the roller and integrally including a gear unit for power transmission and a bushing unit for position control of the roller; and a frame rotatably supporting the bushing unit of the driving gear. A bushing support unit of the frame is preferably supplied with a lubricant, such as oil or grease having a predetermined viscosity, to reduce abrasion.

According to still another embodiment of the present invention, a roller device for an image forming apparatus comprises a rotary roller having a shaft and a driving gear connected with the shaft to rotate together with the roller, wherein the driving gear integrally includes a bushing unit for controlling the position of the roller.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
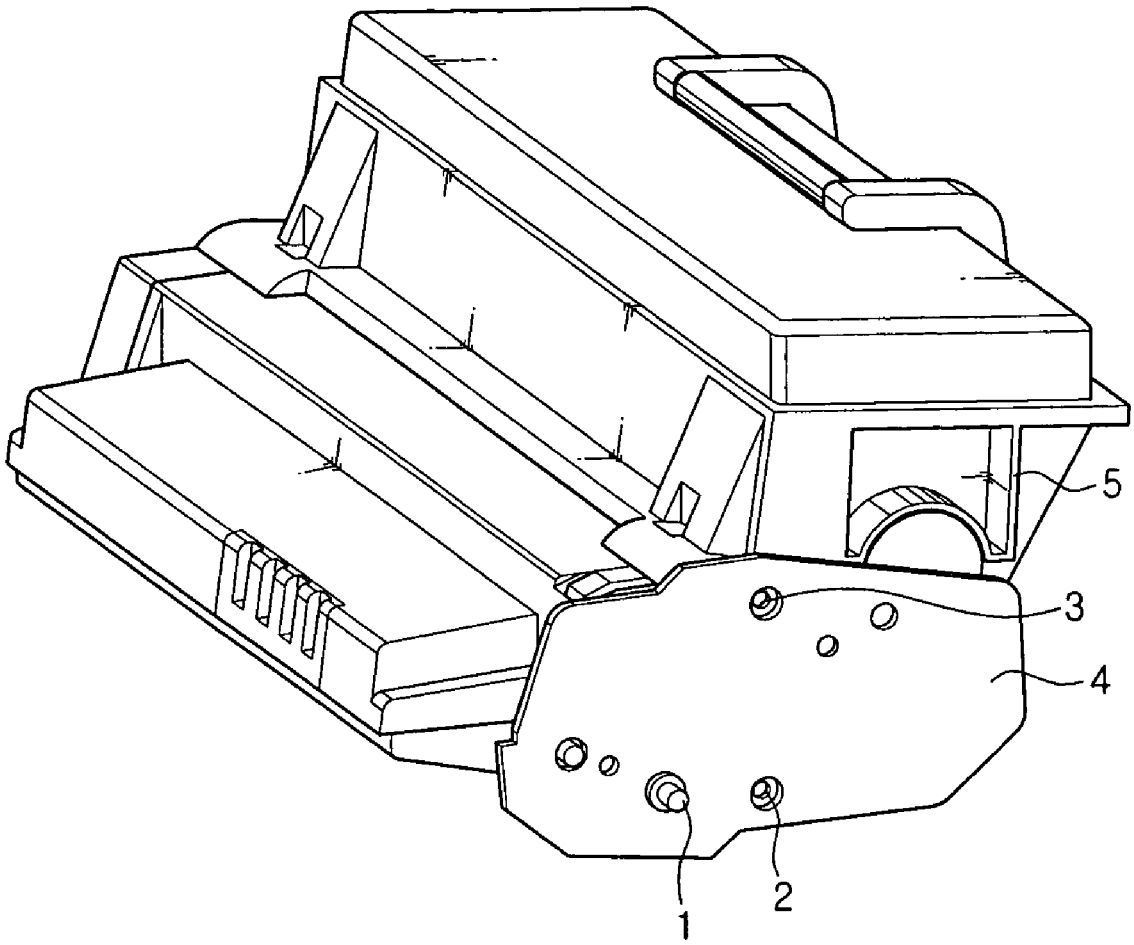
FIG. 1 (PRIOR ART)
FIG. 1 is a perspective view of an exterior of a generic image forming apparatus.
Figure 2:
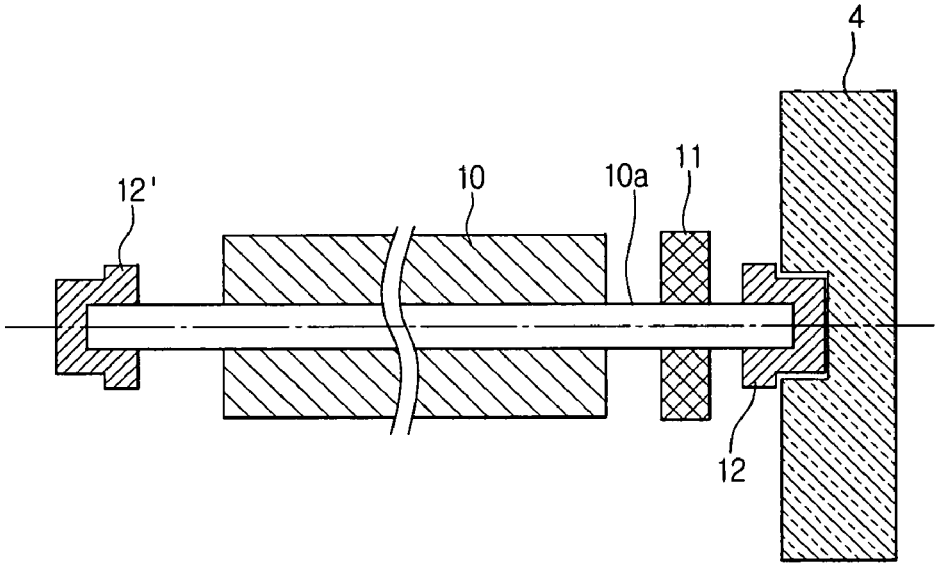
FIG. 2 (PRIOR ART)
FIG. 2 is a view schematically showing a roller device employed in the image forming apparatus of FIG. 1.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 3:
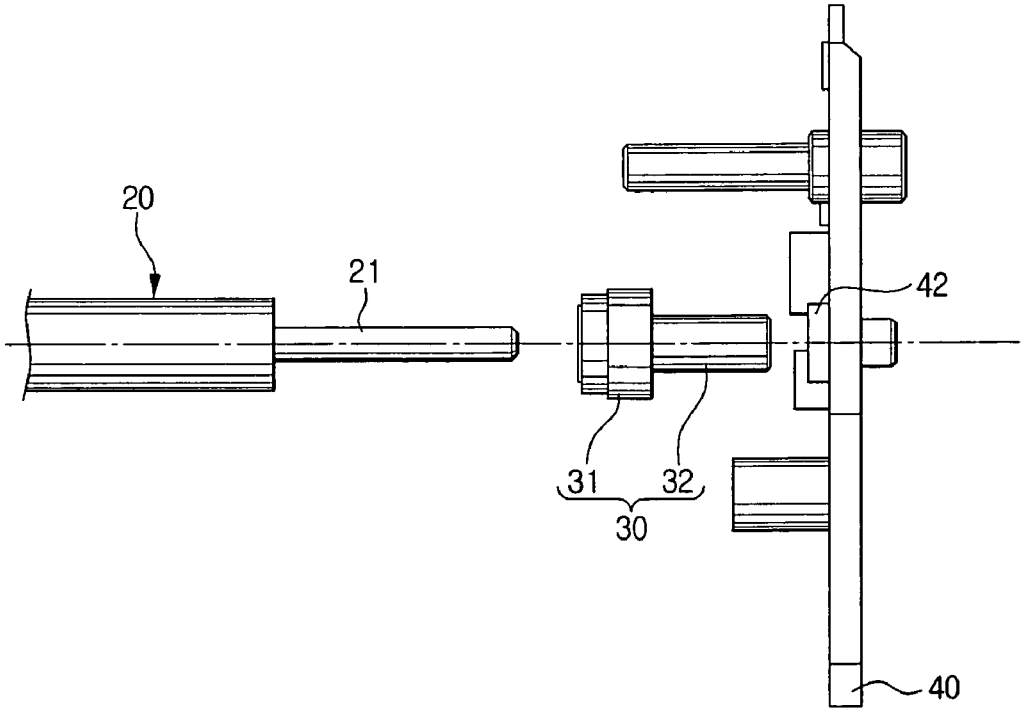
FIG. 3 is a view of a roller device for an image forming apparatus according to an embodiment of the present invention.
Figure 4:
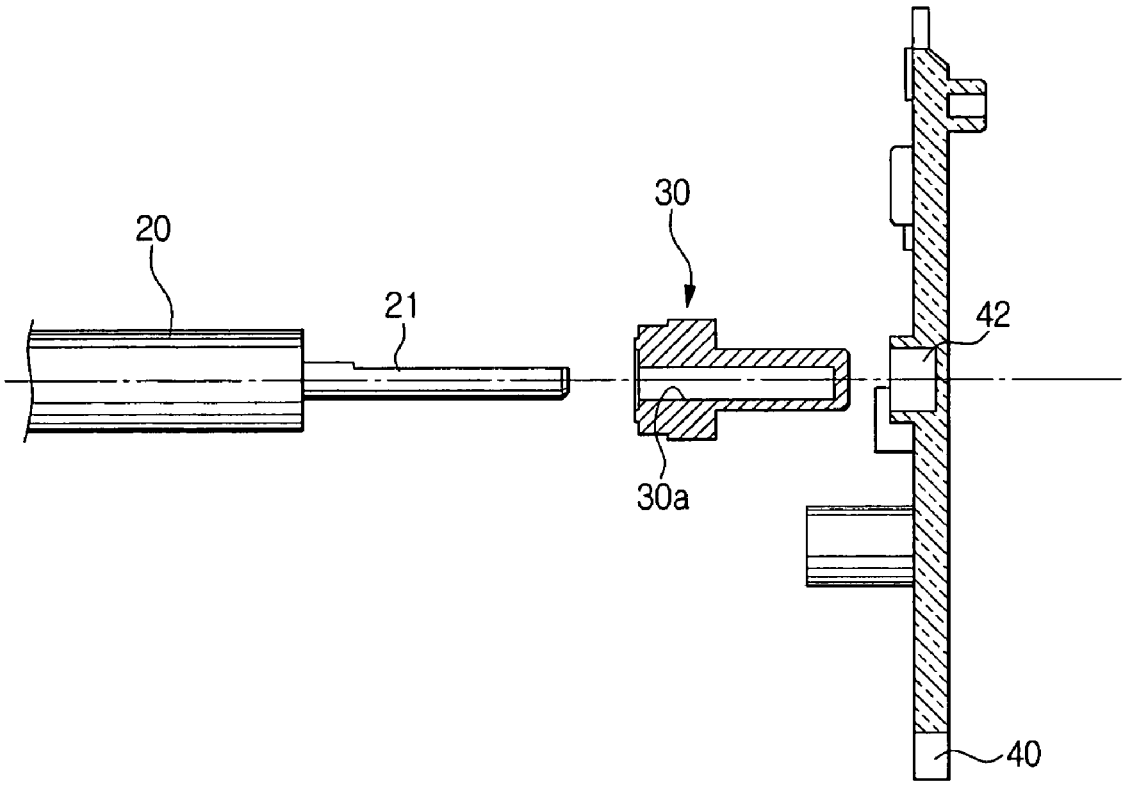
FIG. 4 is a sectional view of FIG. 3.
Figure 5:
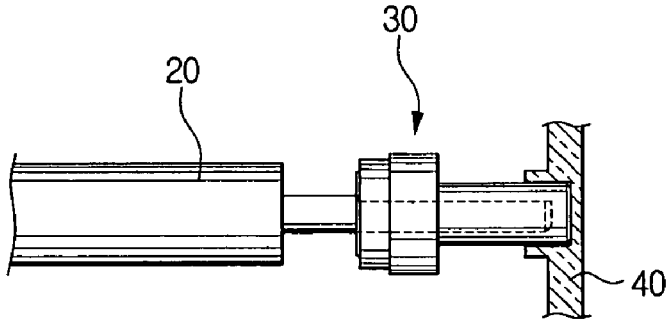
FIG. 5 shows a driving gear being engaged with a shaft of the roller device according to an embodiment of the present invention.

As shown in FIGS. 3 through 5, a roller device for an image forming apparatus, according to an embodiment of the present invention, comprises a rotary roller 20, a driving gear 30 for rotating the rotary roller 20, and a frame 40 rotatably supporting the rotary roller 20.

The roller 20 has a shaft 21 that laterally protrudes from the roller 20. While the roller 20 may be made of a resin, such as rubber, the shaft 21 may be made of metal. The roller 20 herein can be any roller that is driven by a driving gear and that requires precise positioning, including, but not limited to a roller in an image forming apparatus, such as an electrifying roller, a developer supplying roller, a developing roller or an agitator.

The driving gear 30 is connected with the shaft 21. The driving gear 30 integrally comprises a gear unit 31 for power transmission of the roller 20 and a bushing unit 32 controlling position of the roller 20. In addition, the driving gear 30 has a shaft hole 30*a* of a predetermined depth for insertion of the shaft 21. The shaft 21 and the shaft hole 30*a* may be fit with each other through a D-cut. The term "D-cut" as commonly understood refers to a connection of a shaft and an overlying member wherein an end section of the shaft has a D-shaped portion cut away, when viewed along the axis of the shaft and wherein the remaining portion of the shaft fits into a corresponding bore or hole in the overlying member to provide a mechanical engagement between the shaft and the overlying member. Alternatively, the shaft 21 and the shaft hole 30*a* may be engaged by any engagement that can mechanically connect a shaft and an overlying driving gear and can provide a snug transmission of rotational force. For example, the shaft 21 and the shaft hole 30*a* may be engaged by force-fitting, by a key configuration, by which is meant any complementary cross-sectional shapes for the shaft and shaft hole that allows for mechanical engagement, or by an adhesive. The driving gear 30 is preferably formed of plastic so as to prevent abrasion with the plastic frame 40, which will be described hereinbelow.

The frame 40 supports the roller 20 rotatably and has a bushing support unit 42 that contacts the bushing unit 32 of the driving gear 30. It is preferable to apply a lubricant (not shown) on the bushing support unit 42 of the frame 40 to reduce abrasion. The lubricant may be oil or grease having a predetermined viscosity.

The above-structured roller device is assembled by connecting the shaft 21 of the roller 20 with the driving gear 30 integrally having the gear unit 31 and the bushing unit 32 in a manner so that the bushing unit 32 of the driving gear 30 is contactingly supported by the bushing support unit 42 of the frame 40. Power that is supplied externally is transmitted to the shaft 21 through the gear unit 31 of the driving gear 30, thereby rotating the roller 20. The bushing unit 32 of the driving gear 30 is supported by the bushing support unit 42 of the frame 40 and thereby is able to control or maintain the correct positioning of the roller 20. Accordingly, the roller 20 can be rotated and its position can be controlled using a single part, in contrast to rollers of the conventional art, which require a dedicated bushing member. The present invention therefore reduces the risk of misalignment of the roller, which can be caused by assembly tolerance or geometric tolerance of a dedicated bushing member. Since a factor causing the tolerance is thus reduced, the position of reduced, the position of the roller can be precisely controlled and maintained.

As can be appreciated from the above description of an embodiment of the present invention, by precisely controlling the positions of the electrifying roller, the developing roller, the developer supplying roller and the agitator, problems such as white-void, unevenness of horizontal density, unevenness of development and transfer, and inferior supply of developer can be prevented, thereby improving the image quality produced by the image forming apparatus.

In addition, since the bushing unit 32 is integrally formed to the driving gear 30 according to this embodiment, the number of required parts is reduced and accordingly, defects due to assembly tolerance and geometric tolerance can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A roller device for an image forming apparatus, comprising:

a rotary roller having a shaft; and a driving gear directly connected with the shaft to rotate together with the roller, the driving gear integrally including a gear unit that directly transmits a rotating power to the shaft and a bushing unit for position control of the roller.

2. The roller device of claim 1, wherein the driving gear has a shaft hole having a predetermined depth, and wherein the shaft and the shaft hole are engaged with each other.

3. The roller device of claim 2, wherein the shaft and the shaft hole are engaged with each other through a D-cut.

4. The roller device of claim 2, wherein the shaft and the shaft hole are engaged with each other by force-fitting.

5. The roller device of claim 2, wherein the shaft and the shaft hole are engaged with each other by a key configuration.

6. The roller device of claim 2, wherein the shaft and the shaft hole are engaged with each other by an adhesive.

7. The roller device of claim 1 wherein the driving gear is made of plastic and the shaft is made of metal.

8. The roller device of claim 1, wherein the roller is an electrifying roller, a developer supplying roller, a developing roller or an agitator.

9. A roller device for an image forming apparatus, comprising:

a rotary roller having a shaft;

a driving gear having a shaft hole for insertion of the shaft, the driving gear being directly connected with the roller to rotate together with the roller and integrally including a gear unit that directly transmits rotating power to the shaft and a bushing unit for position control of the roller; and a frame rotatably supporting the bushing unit of the driving gear.

10. The roller device of claim 9, wherein the frame comprises a bushing support unit which is supplied with lubricant to reduce abrasion of the bushing unit.

11. The roller device of claim 9, wherein the shaft and the shaft hole are engaged with each other through a D-cut.

12. The roller device of claim 9, wherein the shaft and the shaft hole are engaged with each other by force-fitting.

13. The roller device of claim 9, wherein the shaft and the shaft hole are engaged with each other by a key configuration.

14. The roller device of claim 9, wherein the shaft and the shaft hole are engaged with each other by an adhesive.

15. The roller device of claim 9 wherein the driving gear is made of plastic and the shaft is made of metal.

16. The roller device of claim 9, wherein the roller roller is an electrifying roller, a developer supplying roller, a developing roller or an agitator.

17. A roller device for an image forming apparatus, comprising:

a rotary roller having a shaft; and a driving gear directly connected with the shaft to rotate together with the roller, wherein the driving gear integrally includes a bushing unit for controlling a position of the roller.

18. The roller device of claim 17, wherein the driving gear has a shaft hole having a predetermined depth for insertion of the shaft.

19. The roller device of claim 18, wherein the shaft and the shaft hole are engaged with each other through a D-cut.

20. The roller device of claim 18, wherein the shaft and the shaft hole are engaged with each other by force-fitting.

21. The roller device of claim 18, wherein the shaft and the shaft hole are engaged with each other by a key configuration.

22. The roller device of claim 18, wherein the shaft and the shaft hole are engaged with each other by an adhesive.

23. The roller device of claim 17 wherein the driving gear is made of plastic and the shaft is made of metal.

* * * * *